US005620836A

United States Patent [19]

Heremans et al.

[11] Patent Number: 5,620,836

[45] Date of Patent: Apr. 15, 1997

[54] ASSORTMENT OF SILVER HALIDE PHOTOGRAPHIC INDUSTRIAL X-RAY FILMS AND METHOD OF PROCESSING SAID ASSORTMENT

[75] Inventors: Luc Heremans, Leuven; Raymond Florens, Edegem, both of Belgium

[73] Assignee: Agfa-Gevaert N.V., Mortsel, Belgium

[21] Appl. No.: 517,466

[22] Filed: Aug. 21, 1995

[30] Foreign Application Priority Data

Aug. 22, 1994 [EP] European Pat. Off. ..... 94202398

[51] Int. Cl.[6] ..... G03C 5/16

[52] U.S. Cl. ..... 430/496; 430/966; 430/567; 430/621; 430/642; 430/961; 430/523; 250/475.2; 206/455; 378/169; 378/182

[58] Field of Search ..... 430/966, 567, 430/621, 642, 961, 496, 523; 250/475.2; 206/455; 378/169, 182

[56] References Cited

U.S. PATENT DOCUMENTS

| | | | |
|---|---|---|---|
| 5,397,687 | 3/1995 | Willems et al. | 430/502 |
| 5,413,901 | 5/1995 | Florens et al. | 430/966 |
| 5,445,927 | 8/1995 | Florens et al. | 430/567 |
| 5,447,817 | 9/1995 | Florens et al. | 430/502 |
| 5,462,831 | 10/1995 | Jansen et al. | 430/966 |

FOREIGN PATENT DOCUMENTS

| | | | |
|---|---|---|---|
| 0620482 | 10/1994 | European Pat. Off. | 430/966 |
| 0620483 | 10/1994 | European Pat. Off. | 430/966 |
| 0620484 | 10/1994 | European Pat. Off. | 430/966 |

OTHER PUBLICATIONS

"Science and Technology of Photography" by K. Keller; VCH Verlagsgesellschaft MBH pp. 193, 199 and 212.

"Moderne Photographische System" by Böttcher et al.; VEB Deutscher Verlag für Grundstoffindustrie, Leipzig, DD; p. 196; table 3.9.

Advertising Material AGFA–Gevaert 21.5221, No. 78787, Jul. 1975; pp. 1–6; "Industriele Radiografie Materialen en Systemen".

"NDT Technische Informatie" Factsheet Agfa–Gevaert 21:6260; May 1986; Structurix D3–film.

"A Comparison of 12 X–Ray Films for the Autoradiography of Isotopes Emitting Weak Particles"; International Journal of Applied Radiaton and Isotopes; vol. 34, No. 4, Apr. 1983; pp. 765–767 by Scott et al.; Methods and Tables 1,2.

*Primary Examiner*—Mark F. Huff

*Attorney, Agent, or Firm*—Brumbaugh, Graves, Donohue & Raymond

[57] ABSTRACT

According to this invention an assortment is offered of at least five silver halide industrial X-ray photographic materials, to be processed in the processing cycle of an automatic processing machine following the steps of developing, rinsing, fixing, rinsing and drying, wherein each of said film materials comprises at least one gelatino silver halide emulsion layer and at least one non-sensitive protective antistress coating on at least one side of a support, characterised in that for each of said materials belonging to the assortment the total amount of silver halide, expressed as the equivalent amount of silver nitrate, per square meter and per side is lying in the range from 7.5 to 15 grams, the total amount of gelatin coated in all of the hydrophilic layers present is such and the gelatin is hardened to such an extent that the amount of water absorption is substantially the same for each material and is not more than 2 grams per gram of gelatin after rinsing and before drying each material and that within said assortment the materials are differing in speed.

11 Claims, No Drawings

ASSORTMENT OF SILVER HALIDE PHOTOGRAPHIC INDUSTRIAL X-RAY FILMS AND METHOD OF PROCESSING SAID ASSORTMENT

DESCRIPTION

1. Field of the Invention

This invention relates to an assortment of silver halide photographic industrial X-ray films of different speed classes and a method of manufacturing said films.

2. Background of the Invention

For industrial radiography a film assortment of films differing in speed is offered to the customers by the manufacturers as in practice the choice of a suitable film for a specific application is closely related to the required speed. It is clear that films belonging to different "speed classes" really show a strongly different coating amount of silver halide and gelatin per square meter. In a large number of practical circumstances the so-called "multiple-film" technique is applied, characterised by the use of an assortment of films having a different speed that are consecutively exposed by direct X-rays and consecutively processed in the same automatic processing machine. Films having a higher speed provide less radiation load as exposure times can be shortened, a higher productivity and a longer life cycle of the exposure apparatus.

Minimum demands for image quality are laid down in "standards" for each "sensitivity class" or "image quality class", often related with different applications. A classification in different "speed classes" of films having a different speed is given in the European Standard EN 444. Herein, 4 different classes are cited that offer the hitherto best compromise between sensitivity and image quality after processing in the prescribed processing cycle.

A normal processing cycle is characterised by the following steps: developing at 28° C. and fixing at 26° C., rinsing and drying. The developer is normally composed from three concentrates that should be diluted in the right order: alkaline solution A contains hydroquinone, acidic solution B contains 1-phenyl-3-pyrazolidinone and acidic solution C contains glutaric dialdehyd as hardening agent. The need for the complex three-part packaged developer concentrates has been dictated by the fact that glutaric aldehyd tends to react with 1-phenyl-3-pyrazolidinone, that this pyrazolidinone is unstable in alkaline medium and that glutaric aldehyd tends to polymerize in alkaline medium. The fixer is composed from 2 concentrated solutions, wherein solution A contains the commonly used highly active ammonium thiosulphate as a fixing agent and solution B contains aluminum sulphate as a hardening agent. Hardening agents are necessary not only to lead the film through the processor without damages, but also to reduce the amount of water absorption and, as a consequence, to reduce the drying time and to enhance the drying capacity. This is especially important for industrial X-ray films as these films are coated with a high amount of gelatin e.g. about 30 g/m$^2$. The said high amount of gelatin is a consequence of the need to have high coated amounts of silver halide crystals capable of absorbing direct X-rays in industrial X-ray applications.

From an ecological and an economical point of view, it has been an important step to depart from the concept of hardener containing processing solutions and to work more customer-friendly as has been disclosed in EP-A's 0 621 506, 0 620 483, and 0 620 484. However in hardener free processing the requirements concerning drying capacity and film surface characteristics tend to become more severe.

Although damages of the films in the processor, e.g. due to sticking phenomena which may occur due to an inadequate drying method can be avoided by the use of e.g. infrared dryers in the drying unit of said processor and by application of the method described in EP-A 0 620 482, the problem of getting completely dried films with good physical properties remains after processing of said films differing in speed.

Differences in speed by the presence of different coating amounts of silver and gelatin, should require a change of the drying capacity of the drying station for each film apart during its processing cycle as otherwise films having low amounts of gelatin would show deformations of the material in the drying unit, whereas films having high sensitivity and high amounts of gelatin would not be completely dried and show sticking phenomena. Said sticking phenomena of the film at the transport rollers obviously result in a distortion of the images, making them unavailable for diagnostic purposes like examinations of welded seams for applications as e.g. pipe-lines, wherefor image quality, especially detail rendering, should be excellent.

3. Objects of the Invention

It is an object of the present invention to provide an assortment of industrial X-ray films, characterised by a difference in speed and image quality, wherein said films can be processed with hardener-free or hardener containing processing chemicals in automatic processing machines within the same processing cycle and within the same processing time.

It is another object to provide a method of manufacturing said assortment of films, differing in speed and image quality, resulting after processing in images having comparably good physical surface characteristics without damage of the surface of said films due to e.g. sticking and wherein the obtained images have a good diagnostic value thanks to a good image quality, especially sharpness.

Further objects will become apparent from the description hereinafter.

4. Summary of the Invention

According to this invention an assortment is offered of silver halide industrial X-ray photographic materials, said assortment having at least five films to be processed in the processing cycle of an automatic processing machine following the steps of developing, rinsing, fixing, rinsing and drying, wherein each of said film materials comprises at least one gelatino silver halide emulsion layer and at least one non-sensitive protective antistress coating on at least one side of a support, characterised in that for each of said materials belonging to the assortment the total amount of silver halide, expressed as the equivalent amount of silver nitrate, per square meter and per side is lying in the range from 7.5 to 15 grams, the total amount of gelatin coated in all of the hydrophilic layers present is such and the gelatin is hardened to such an extent that the amount of water absorption is substantially the same for each material and is not more than 2 grams per gram of gelatin after rinsing and before drying each material and that within said assortment the materials are differing in speed.

5. Detailed Description of the Invention

According to the present invention it has been realised to get an assortment of films, differing in speed and image quality, wherein at least five films belonging to said asortment are dried in about the same time within the drying section during processing in an automatic processing machine.

Different ways to reach this goal are related with the total processing time provided in an automatic processor.

According to this invention the processing step proceeds in a total processing time from 3 to 12 minutes. It has been found that, depending on said total processing time, two different manufacturing methods can be applied.

For short processing times in the range from about 3 to about 7 minutes, it has to be recommended to take as the amount of the coated gelatin for each of the films of the assortment a lower and a substantially same total amount of gelatin in the emulsion layer(s) of at least 2.5 grams per side of the support as the total processing time is relatively short. Thus the method of manufacturing of an assortment of films corresponding to this invention proceeds by the steps of coating gelatin in the emulsion layer in amounts corresponding with amounts of gelatin of at least 2.5 grams and hardening each film belonging to said assortment to such an extent that the amount of water absorption is substantially the same for each material belonging to said assortment and not more than 2 grams per gram of gelatin after rinsing and before drying.

By taking as amount of gelatin for each of the films of the assortment that of the film that normally has the lowest gelatin content, the pressure sensitivity of the more sensitive films may become worse and higher gelatin amounts can be chosen. This will pose no problem as the degree of hardening of said films should be adapted to the processing requirements, i.e. the processing times. Thus the method of manufacturing of an assortment of films corresponding to this invention can also proceed by the use of gelatin in the emulsion layer and in the protective layer in higher amounts, provided each film belonging to said assortment is hardened to such an extent that the amount of water absorption is substantially the same for each material belonging to said assortment and is not more than 2 grams per gram of gelatin after rinsing and before drying.

For processing times in the range from 8 to 12 minutes films are manufactered as described hereinbefore. In this condition however the drying unit in the automatical processing machine is adjusted in such a way that the drying temperature is lower.

In another embodiment an increasing drying time is obtained if the films of the assortment are coated with more gelatin, resulting in an enhancement of the "gesi". Said enhancement of the "gesi" normally results in a lower film speed for the same processing time. In order to compensate for this loss in speed the processing time is increased. Minimum amounts of a total gelatin content in the emulsion layer(s) at one side the support of at least 4.5 grams per square meter are preferred.

Alternatively by lowering the hardening degree of said films, a higher amount of water absorption is obtained before drying. As long as for each material belonging to an assortment of materials according to this invention a substantially same amount of water absorption of not more than 2 grams per gram of gelatin, said assortment corresponds to the objects of this invention.

It is clear that measures to increase the processing time as described hereinbefore can be combined.

Manufacturing an assortment according to this invention for films having a minimum amount of a total gelatin content in the emulsion layer(s) at one side the support of at least 4.5 grams per square meter preferably proceeds by coating more gelatin in the protective antistress layer or by a layer arrangement wherein a gelatin undercoat layer is applied, adjacent to the emulsion layer and situated more closely to the support.

The objects of this invention can thus be obtained by providing materials belonging to an assortment of at least five films provided that the amount of water absorption is substantially the same for each material belonging to said assortment and is not more than 2 grams per gram of gelatin after rinsing and before drying. It is preferred to have an amount of water absorption of not less than 0.9 grams per gram of gelatin in order to avoid pressure sensitivity of the materials. Moreover for all materials belonging to an assortment of materials according to this invention having a water absorption that is substantially the same it is preferred that differences in water absorption should be less than 20% of the average amount of water absorption, calculated from the amounts measured for all of the materials belonging to said assortment in order to get materials leaving the processor showing no sticking phenomena, nor deformation.

Although the gelatin binder of the assortment of at least five industrial X-ray film materials according to this invention can be hardened with whatever a hardener, according to this invention the gelatin binder of the silver halide photographic industrial X-ray materials having different speeds is preferably hardened with hardening agents of the vinylsulphone type. Especially di-(vinylsulphonyl)-methane and ethylene di-vinyl-sulphone are preferred. As opposed to aldehyde type hardeners, like e.g. formaldehyde, vinylsulphone type hardeners used to harden industrial X-ray materials do not show disadvantageous sticking phenomena between the film and the rollers in the drying section of an automatic processor with infrared dryers as drying means in that section of the automatic processing unit, the effect being more pronounced if hardener-free chemicals are used in the developer and/or fixer.

The hardening agent may be added to the coating composition of the emulsion layer(s) and/or to the coating composition of the protective antistress layer(s) before or during the coating procedure applied to prepare the materials differing in speed. If the hardener is added during the coating procedure it is still possible to make corrections for the water absorption of the material that has to be coated further on by controlling the amount of water absorption for the coated material directly after coating.

Whatever the amount of gelatin or "gesi" of the film materials belonging to the assortment of industrial X-ray films according to this invention, hardening is provided to such an extent that, when the photographic material is rinsed at the end of the processing cycle just before drying, an amount of less than 2 grams of water per gram of gelatin per square meter and per side of said material should be absorbed. For each of the films of the assortment this amount should be the substantially the same.

The silver halide emulsions coated in the silver halide emulsion layer(s) of the materials, belonging to the assortment of films according to this invention, comprise silver chloride, silver chlorobromide, silver chlorobromoiodide, silver bromide or silver bromoiodide. Suitable silver chloride and silver chlorobromide emulsions have e.g. been described in EP-A 538 947, filed Oct. 24, 1991, whereas other suitable materials substantially consisting of silver bromoiodide emulsions have been described e.g. in EP-A 555 897, filed Feb. 14, 1992 and in EP-A 0 622 668.

Preferred emulsions are silver bromoiodide emulsions comprising at most 10 mole % of iodide, preferably at most 3 mole % and still more preferably 1 mole %. It is preferred to use regular-shaped silver halide crystals and more particularly silver bromoiodide emulsions with a cubic crystal habit which are used in industrial radiographic materials and are known to have good development characteristics with respect to high speed.

During the precipitation stage of the emulsion making the parameter determining whether cubic or octahedral crystals are formed is the pAg of the solution.

The pAg of the solution may be regulated by any of the means known in the art of emulsion making, such as the electronic control apparatus and method disclosed in U.S. Pat. No. 3,821,002.

From the article "Der Einfluβ der Wachstumsbedingungen auf die Kristalltracht der Silberhalogenide" (the influence of Growth Conditions on the Crystalline Behaviour of Silver halides) von E. Moisar and E. Klein, Bunsengesellschaft für physikalische Chemie, Berichte 67 949–957 (1963) No 9.10., it is known that on allowing tetradecahedral crystals of a homodisperse silver bromide emulsion to grow by controlled addition of solutions of silver nitrate and potassium bromide, crystals of cubic form are obtained under conditions of low excess bromide concentration in the solution phase. A preferred embodiment of making the emulsions used according to the present invention involves the preparation of high-sensitive silver bromoiodide emulsions as these X-ray emulsions, by precipitation under double jet conditions. Although nowadays processes for the preparation of homogeneous silver halide emulsions make use of special control devices to regulate the form of the resulting silver halide crystals, said form mainly being determined by the pAg value and temperature in the reaction vessel, the silver ion concentration can be kept constant during the precipitation by the use of a special inlet technique as described in Research Disclosure 10308.

Although iodide ions, if present, can be distributed over the crystal volume in whatever a way, as e.g. divided heterogeneously as in so-called core-shell emulsion crystals, it is preferred to prepare crystals with homogenously divided iodide ions over the whole crystal volume.

The average grain-size of the silver halide emulsions made for the materials differing in sensitivity according to the present invention are situated between 0.1 and 2.0 μm and more preferably between 0.1 and 1.0 μm. Particle size of silver halide grains can be determined using conventional techniques e.g. as described by Trivelli and M. Smith, The Photographic Journal, vol. 69, 1939, p. 330–338, Loveland "ASTM symposium on light microscopy" 1953, p. 94–122 and Mees and James "The Theory of the photographic process" (1977), Chapter II.

To obtain a reproducible crystal size especially the flow rate and concentration of the solutions, the temperature and pAg have to be adjusted very carefully. Grain-growth restrainers or accelerators may be added from the start or during the preparation of the emulsion crystals. Depending on the initial conditions during precipitation, monodispersed emulsions can be prepared as is preferred for this invention. Monodispersed emulsions in contrast to heterodispersed emulsions have been characterized in the art as emulsions of which at least 95% by weight or number of the grains have a diameter which is within about 40%, preferably within about 30% of the mean grain-diameter and more preferably within about 10% to 20%.

Silver halide grains having a very narrow grain-size distribution can thus be obtained by strictly controlling the conditions at which the silver halide grains are prepared using a double jet procedure. In such a procedure, the silver halide grains are prepared by simultaneously running an aqueous solution of a water-soluble silver salt, e.g., silver nitrate, and water-soluble halide, e.g., a mixture of potassium bromide and potassium iodide, into a rapidly agitated aqueous solution of a silver halide peptizer, preferably gelatin, a gelatin derivative or some other protein peptizer. Even colloidal silica may be used as a protective colloid as has been described in EP-Applications 392 092; 517 961 and 528 476, as well as in EP-A 0 649 051.

In a preferred embodiment the rates of addition of the silver nitrate and the halide salt solutions are steadily increased in such a way that no renucleation appears in the reaction vessel. This procedure is especially recommended, not only to save time but also to avoid physical ripening of the silver halide crystals during precipitation, the so-called Ostwald ripening phenomenon, which gives rise to the broadening of the silver halide crystal distribution.

Once the grains have reached their ultimate size and shape, the emulsions are generally washed after being flocculated to remove the by-products of grain formation and grain-growth. In order to remove the excess of soluble salts washing is applied at a pH value which can vary during washing-but remains comprised between 3.7 and 3.0 making use of a flocculating agent like polystyrene sulphonic acid. The emulsion may be washed by diafiltration by means of a semi-permeable membrane, also called ultrafiltration, so that it is not necessary to use polymeric flocculating agents that may disturb the coating composition stability before, during or after the coating procedure. Such procedures are disclosed e.g. in Research Disclosure Vol. 102, Oct. 1972, Item 10208, Research Disclosure Vol. 131, March, Item 13122 and Mignot U.S. Pat. No. 4,334,012. Preferably, at the start of the ultrafiltration, there is no pH and pAg adjustment as pH and pAg are maintained at the same level as at the end of the preceding precipitation without any adjustment stage.

In accordance with the present invention, the emulsions are preferably washed by acid-coagulation techniques using acid-coagulable gelatin derivatives or anionic polymeric compounds or, when precipitation occurred in silica medium, by certain polymers capable of forming hydrogen bridges with silica, in an amount sufficient to form coagulable aggregates with the silica particles as has been described in EP Application 517 961.

Coagulation techniques using acid-coagulable gelatin derivatives have been described e.g. in the U.S. Pat. Nos. 2,614,928, 2,614,929 and 2,728,662. The acid-coagulable gelatin derivatives are reaction products of gelatin with organic carboxylic or sulphonic acid chlorides, carboxylic acid anhydrides, aromatic isocyanates or 1,4-diketones. The use of these acid-coagulable gelatin derivatives generally comprises precipitating the silver halide grains in an aqueous solution of the acid coagulable gelatin derivative or in an aqueous solution of gelatin to which an acid coagulable gelatin derivative has been added in sufficient proportion to impart acid-coagulable properties to the entire mass. Alternatively, the gelatin derivative may be added after the stage of emulsification in normal gelatin, and even after the physical ripening stage, provided it is added in an amount sufficient to render the whole coagulable under acid conditions. Examples of acid-coagulable gelatin derivatives suitable for use in accordance with the present invention can be found e.g. in the U.S. patents referred to above. Particularly suitable are phthaloyl gelatin and N-phenylcarbamoyl gelatin.

The coagulum formed may be removed from the liquid by any suitable means, for example the supernatant liquid is decanted or removed by means of a siphon, where upon the coagulum is washed out once or several times.

Washing of the coagulum may occur by rinsing with mere cold water. However, the first wash water is preferably acidified to lower the pH of the water to the pH of the coagulation point. Anionic polymer e.g. polystyrene sulphonic acid may be added to the wash water even when an acid coagulable gelatin derivative has been used e.g. as described in published German Patent Specification (DOS) 2,337,172 mentioned hereinbefore. Alternatively washing may be effected by redispersing the coagulum in water at elevated temperature using a small amount of alkali, e.g. sodium or ammonium hydroxide, recoagulating by addition of an acid to reduce the pH to the coagulation point and subsequently removing the supernatant liquid. This redispersion and recoagulation operation may be repeated as many times as is necessary.

After the washing operation, the coagulum is redispersed to form a photographic emulsion suitable for the subsequent finishing and coating operations by treating, preferably at a temperature within the range of 35° to 70° C., with the required quantity of water, gelatin and, if necessary, alkali for a time sufficient to effect a complete redispersal of the coagulum.

Instead or in addition to normal gelatin, which is preferably used, other known photographic hydrophilic colloids can also be used for redispersion e.g. a gelatin derivative as referred to above, albumin, agar-agar, sodium alginate, hydrolysed cellulose esters, polyvinyl alcohol, hydrophilic polyvinyl copolymers, colloidal silica etc.

The light-sensitive silver halide emulsions are chemically sensitized with a sulphur and gold sensitizer. This can be done as described i.a. in "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mir Silberhalogeniden" edited by H. Frieser and published by Akademische Verlagsgesellschaft (1968). As described in said literature sulphur sensitization can be carried out by effecting the ripening in the presence of small amounts of compounds containing sulphur e.g. thiosulphate, thiocyanate, thioureas, sulphites, mercapto compounds, and rhodamines. Gold sensitization occurs by means of gold compounds. In addition small amounts of compounds of Ir, Rh, Ru, Pb, Cd, Hg, Tl, Pd or Pt can be used. The emulsion can be sensitized in addition by means of reductors e.g. tin compounds as described in GB-A 789,823, amines, hydrazine derivatives, formamidine-sulphinic acids, and silane compounds.

If more than one silver halide emulsion is used in one or more emulsion layers, the said halide emulsions are chemically ripened separately.

In accordance with the present invention compounds for preventing the formation of fog or stabilizing the photographic characteristics during the production or storage of photographic elements differing in sensitivity or during the photographic treatment thereof may be supplementary added. Examples of such stabilizers are heterocyclic nitrogen-containing stabilizing compounds as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methyl-benzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JA-Appl. 75-39537, and GB-A 1,500,278, and 7-hydroxystriazolo-[1,5-a]-pyrimidines as described in U.S. Pat. No. 4,727,017, and other compounds such as benzenethiosulphonic acid, benzenethiosulphinic acid, benzenethiosulphonic acid amide and other disulfide derivatives, which are giving an unsatisfactory result if added as the sole stabilizing agent and are therefore combined with other stabilizers belonging to the classes of stabilizers already mentioned. On the other hand mercury salts and other metal-salts that can be used as fog-inhibiting compounds such as cadmium salts and related compounds described in Research Disclosure N° 17643 (1978), Chapter VI, should be avoided for reasons of ecology.

The weight ratio of gelatin to silver halide (expressed as silver nitrate) in the silver halide emulsion layers of the assortment of photographic materials according to the present invention is comprised between 0.3 and 1.2, and more preferably between 0.4 and 1.0.

For industrial radiography the silver halide emulsion layer(s) of the materials differing in speed and belonging to said assortment according to this invention comprise total amounts of silver halide, coated per side and per square meter of from 7.5 to 15 g, expressed as the equivalent amounts of silver nitrate.

The photographic elements under consideration differing in speed may further comprise various kinds of surface-active agents in the photographic emulsion layer and/or in at least one other hydrophilic colloid layer.

It has been found that if for industrial X-ray photographic films having the mentioned high amount of silver halide per square meter, one or more polyoxyalkylene compound(s) (is) are simultaneously present as surfactants in accordance with a preferred embodiment, dust at the film surface after processing disappears to an acceptable level.

Preferred polyoxyalkylene compound reducing dust to an acceptable level are described in EP-A's 0 620 482, 0 620 483 and 0 620 484, which are incorporated herein by reference.

Both the polyoxyalkylene compound(s) and the hardener(s) described hereinbefore are preferably present in at least one of the non light-sensitive layers and more preferably both compounds are added to the protective antistress layer which is preferably present as an outermost layer at both sides of the support.

Other preferred surface-active coating agents are compounds containing perfluorinated alkyl groups. Other suitable surface-active agents include non-ionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone polyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts.

Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g higher contrast, sensitization, and development acceleration.

Development acceleration can be accomplished with the aid of various compounds, preferably polyalkylene derivatives having a molecular weight of at least 400 such as those described in e.g. U.S. Pat. Nos. 3,038,805; 4,038,075 and 4,292,400.

The photographic elements differing in sensitivity used according to this invention may further comprise various other additives such as e.g. compounds improving the dimensional stability of the photographic element, UV-absorbers, spacing agents and plasticizers.

Suitable additives for improving the dimensional stability of the photographic element are i.a. dispersions of a water-soluble or hardly soluble synthetic polymer e.g. polymers of alkyl (meth)acrylates, alkoxy(meth)acrylates, glycidyl (meth)acrylates, (meth)acrylamides, vinyl esters, acrylonitriles, olefins, and styrenes, or copolymers of the above with acrylic acids, methacrylic acids, Alpha-Beta-unsaturated dicarboxylic acids, hydroxyalkyl (meth)acrylates, sulphoalkyl (meth)acrylates, and styrene sulphonic acids.

Suitable UV-absorbers are i.a. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455.

In general, the average particle size of spacing agents is comprised between 0.2 and 10 μm. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

The photographic element can comprise an antistatic layer e.g. to avoid static discharges during coating, processing and other handlings of the material. Such antistatic layer can be an outermost coating or stratum of one or more antistatic agents or a coating applied directly to the film support. Said antistatic layer(s) may be overcoated with a barrier layer of e.g. gelatin. Antistatic compounds suitable for use in such layers are e.g. vanadium pentoxide sols, tin oxide sols or conductive polymers such as polyethylene oxides, polymer latices and the like.

The support of the photographic materials used in accordance with the present invention may be a transparent resin, preferably a blue coloured polyester support like polyethylene terephtalate. The thickness of such organic resin film is preferably about 175 μm. The support is provided with a substrate layer at both sides to have good adhesion properties between the emulsion layer and said support.

Depending on the crystal size of the silver halide crystals present in the emulsion layer(s) of the materials differing in sensitivity a further fine-tuning of the outlook of the film may be required. Therefore the absorption spectrum of the material as obtained after the processing cycle described hereinafter may be obtained by the addition of suitable non-migratory dyes to the subbing layer, the emulsion layer(s) or the protective antistress layer(s) or to the topcoat layer at both sides of the support. A blue coloured dye is therefore recommended, especially for films having a lower speed.

The photographic industrial X-ray materials differing in speed used according to this invention can be image-wise exposed by means of an X-ray radiation source the energy of which, expressed in kV, depends on the specific application. Another typical radiation source is a radioactive $Co^{60}$ source. To reduce the effect of scattering radiation a metal screen, usually a lead screen, can be used in combination with the photographic film. The generation of secondary electrons by this metal screen enhances the sensitivity.

For processing, an automatically operating apparatus is used provided with a system for automatic replenishment of the processing solutions. In accordance with this invention the processing of the materials exposed as described hereinbefore proceeds by the steps of developing, rinsing, fixing, followed by rinsing and drying in automatic processing machines with drying means in the film-drying station. Infrared lamps are used as drying means.

The developer solution according to the invention should be replenished not only for decrease of the liquid volume due to crossover into the next processing solution but also for pH-changes due to oxidation of the developer molecules. This can be done on a regular time interval basis or on the basis of the amount of processed film or on a combination of both. The development step is followed by a washing step, a fixing solution and another washing or stabilization step. Finally after the last washing step the photographic material is dried by means of infrared drying means as cited hereinbefore.

In a preferred embodiment the assortment of at least five film materials according to this invention includes at least one photographic material which is a single-side coated material having on one side of the film support at least one emulsion layer and at least one protective antistress layer and on the other side of said support at least one backing layer.

In another embodiment the assortment according to this invention has at least four silver halide industrial X-ray photographic materials, to be processed in the processing cycle of an automatic processing machine following the steps of developing, rinsing, fixing, rinsing and drying, wherein each of said film materials comprises at least one gelatino silver halide emulsion layer and at least one non-sensitive protective antistress coating on both sides of the film support.

It is clear that the manufacturing of assortments of film materials according to this invention takes into account the ranges of amounts of coated silver halide and gelatin and the extent to which said materials should be hardened as described hereinbefore.

As a result a quite unexpected improvement is observed in the physical characteristics of the film surfaces of all films according to this invention, differing in speed. No sticking and/or damaging of the film surfaces appears after the films of the assortment have passed at random order the drying station of the processing machines equipped with the infrared drying means.

Further improvements consisting in measures in the processing in automatical processing machines of the materials according to this invention described hereinbefore have been described in EP-A's 0 621 506, 0 620 482, 0 620 483 and 0 620 484, and which are incorporated herein by reference.

It is clear that the improvements observed for industrial X-ray films differing in speed will also apply to X-ray medical films having a high silver halide content as in image formation techniques related with medical diagnosis a radiologist makes use of an assortment of films differing in specific application field, but with a processing that proceeds in the same automatical processing machine. A typical application field, most frequently used therein, is projection radiography, wherein double side coated materials are used in combination with a pair of intensifying screens or single side coated materials combined with only one intensifying screen to improve sharpness as for mammography. Further applications are image intensifyer photography where a hardcopy is made from a monitor, as for echography, and where the photographic material should be sensitive to the wavelength of the phosphor coated on the phosphor screen of said monitor. Still further applications are related with stored digital information as in CT- and MRI-imaging techniques, where the same method to make a hardcopy as hereinbefore can be applied, but where nowadays laser imagers are used and where films are spectrally sensitive to the laser light of the (red or infrared) laser that has been installed. Whatever application used, the whole assortment of films differing in specific application field should be processed in the same automatical processing machine for the same time.

The following examples illustrate the invention without however limiting it thereto.

6. EXAMPLE

A gelatino silver iodobromide X-ray emulsion comprising 99 mole % of silver bromide and 1 mole % of silver iodide was prepared in the following way. An aqueous solution containing 6 grams of ammonia was added to the reaction vessel containing 1550 ml of a 3% by weight aqueous solution of gelatin at 45° C. Into said reaction vessel a solution of 2000 ml of an aqueous 1.5 molar solution of potassium bromide and a solution of 2000 ml of an aqueous 1.5 molar solution of silver nitrate were introduced at constant rate of 86 ml/min under vigorously stirring conditions. During precipitation the pAg value was adjusted to and maintained at a value corresponding to an E.M.F. of +20 mV with reference to a silver/saturated calomel electrode. In this way homogeneous and regular silver halide grains having a crystal diameter of 0.80 μm were obtained.

At the end of the precipitation step, the emulsion was coagulated by adding polystyrene sulphonic acid acting as a flocculating agent after adjustment of the pH value of the emulsion in the reaction vessel to 3.5 with sulphuric acid. After rapid sedimentation of said silver halide emulsion the supernatant liquid was decanted. To remove the water-soluble salts from said flocculate, demineralized water of 11° C. was added under controlled stirring conditions followed by a further sedimentation and decantation. This washing procedure was repeated until the emulsion was sufficiently desalted. Thereafter the coagulum was redispersed at 45° C. in water after the addition of a sufficient amount of gelatin to obtain a ratio of gelatin to silver halide expressed as silver nitrate of 0.4. The pH-value was adjusted to 6.5 and pAg to a value of +70 mV with reference to the silver/saturated calomel electrode.

Chemical sensitization of said emulsion was performed by the addition of a sulphur and gold sensitizer and digestion at 50° C. to the point where the highest sensitivity was reached for a still acceptable fog level.

This emulsion was coated at both sides of a blue polyethylene terephtalate support having a thickness of 175 μm, so that per sq. m. and per side an amount of silver halide corresponding to 20.0 g of silver nitrate and 17.0 g of gelatin were present. This corresponds with a "gesi" value, defined as the ratio by weight of the total coated amount of gelatin (GEL=corresponding to the total amount at both sides) and silver (AG=corresponding to the total amount at both sides), expressed as the equivalent amount of silver nitrate, of 0.85. Before coating material G stabilizers such as 5-methyl-7-hydroxy-5-triazolo-[1,5-a]-pyrimidin and 1-phenyl-5-mercaptotetrazol were added to the emulsion.

The emulsion layers were covered at both sides with a protective layer of 1.5 grams of gelatin per square meter (GELPL=corresponding to the total amount at both sides), which was hardened with 0.093 g of di-(vinyl-sulphonyl)-methane per square meter.

Films A, B', C, D, E, F and G, belonging to an assortment of films, were obtained in the same way but the size of the emulsion crystals was varying from 0.18 μm to 0.8 μm in order to get films having a different speed, with amounts per square meter of silver halide, expressed as the equivalent amount of silver nitrate and of gelatin as summarised in Table 1, wherein also the values of the gesi (GESI) of the emulsion layer(s) of light-sensitive material is given. Differences in speed can be calculated from differences in the "Relative Exposure Factor" (REF) for an exposure with a 200 kV radiation source, given in Table 1 (last column).

Further the total amount of gelatin (GELTOT) is given as well as the total amount of water absorption (ABS TOT) and the amount of water absorption, expressed in grams per gram of gelatin (WAT ABS). This value has been determined by removing the film from the processor after leaving the rinsing unit and before entering into the drying unit and calculating the difference by weight between the wet film removed from the processor and the dry film, before inserting in the processor. The measurement took place at a temperature of 21° C. and 50% RH (relative humidity).

In order to have the same amount of gelatin (GELTOT) as for film A, according to our invention for the films B, C, D, E, F and G the "gesi" of the emulsion was respectively adapted as indicated for films B', C', D', E', F' and G'. As a result a new assortment of films A, B', C', D', E', F' and G' was created.

It should be noted that for the film B', an emulsion layer B is only coated at one side of the support and that in this case the amount of gelatin coated at the side of the backing layer is equal to that coated normally in the emulsion layer and the protective layer at the emulsion side.

The coated and dried films were exposed according to ISO 7004 with a 235 kV radiation source with a copper filter of 8 mm thickness.

TABLE 1

| Film | AG ($g/m^2$) | GEL ($g/m^2$) | GESI | GELPL | GEL-TOT | ABS TOT | WAT ABS | REF |
|---|---|---|---|---|---|---|---|---|
| A | 20 | 17.00 | 0.85 | 3.0 | 20 | 34.2 | 1.71 | 8.7 |
| B | 10 | 8.50 | 0.85 | 1.5 | 10 | — | — | 17.4 |
| B' | 10 | 17.00 | 0.85 | 3.0 | 20 | 33.8 | 1.69 | 17.4 |
| C | 25.5 | 19.12 | 0.75 | 3.0 | 22.12 | 37 | 1.67 | 4.2 |
| C' | 25.5 | 17.08 | 0.67 | 3.0 | 20.08 | 33.5 | 1.67 | 4.2 |
| D | 19.5 | 15.60 | 0.80 | 3.0 | 18.6 | 31.4 | 1.69 | 2.6 |
| D' | 19.5 | 16.96 | 0.87 | 3.0 | 19.96 | 33.7 | 1.69 | 2.6 |
| E | 24.0 | 20.40 | 0.85 | 3.0 | 23.40 | 46.0 | 1.96 | 1.6 |
| E' | 24.0 | 17.04 | 0.71 | 3.0 | 20.04 | 34.5 | 1.72 | 1.6 |
| F | 29.0 | 24.6 | 0.85 | 3.0 | 27.6 | 60.0 | 2.17 | 1.0 |
| F' | 29.0 | 17.11 | 0.59 | 3.0 | 20.11 | 35.2 | 1.75 | 1.0 |
| G | 29.0 | 24.6 | 0.85 | 3.0 | 27.6 | 60.0 | 2.17 | 0.7 |
| G' | 29.0 | 17.11 | 0.59 | 3.0 | 20.11 | 35.2 | 1.75 | 0.7 |

The exposed radiographic films were developed, rinsed, fixed, rinsed and dried in an automatic machine processing cycle of 8 minutes. The film was run in a Structurix NDT-1 machine marketed by Agfa-Gevaert and developed at 28° C. in a one-part package developer, followed by fixation in a one-part package fixer as described hereinafter.

The composition of the concentrated one-part package developer (amounts given in grams/liter) is as follows:

| | |
|---|---|
| water | 200 ml |
| potassium bromide | 6 grams |
| potassium sulphite (65% solution) | 247 grams |
| ethylenediamine tetraacetic acid, tetrasodium salt trihydrate | 9.6 grams |
| hydroquinone | 112.0 grams |
| 5-methylbenzotriazole | 0.076 grams |
| 1-phenyl-5-mercaptotetrazole | 0.040 grams |
| sodium tetraborate (decahydrate) | 18.0 grams |
| potassium carbonate | 38.0 grams |
| potassium hydroxyde | 42.0 grams |
| diethylene glycol | 100.0 grams |
| potassium iodide | 0.088 grams |
| 4-hydroxymethyl-4-methyl-1-phenyl-3-pyrazolidinone | 12.0 grams |

Water to make 1 liter.
pH adjusted to 11.15 at 25° C. with potassium hydroxide.
For initiation of the processing one part of the concentrated developer was mixed with 3 parts of water. No starter was added. The pH of the mixture was 10.40 at 25° C.
The composition of the concentrated one-part package fixer:

| | |
|---|---|
| ammoniumthiosulphate (59% solution) | 552 grams |
| boric acid | 20.8 grams |
| sodium sulphite | 45 grams |
| sodium acetate.3 aq | 58 grams |
| sulphuric acid (99% solution) | 48.5 ml |

Water to make 1 liter.
pH adjusted to 4.80 at 25° C. with sulphuric acid.
For initiation of the processing 1 part of the concentrated fixer was mixed with 4 parts of water.
The pH of this mixture was 4.73 at 25° C.

In the drying section infrared drying means were present. An evaluation of the surface state of the processed film was made after the film had left the processor.

At different drying levels, kept the same for each assortment of films to be processed as set forth in Table 1, the films A, B', C, C', D, D', E, E', F' and G' were perfectly dried, showing no sticking phenomena. Only for the films F and G having a water absorption per gram of gelatin and per square meter of more than 2.0, the film was not completely dry after processing and as a result sticking phenomena were observed.

To prevent sticking of said films F and G the drying level was enhanced, but as a result the other films of the assortment to be processed showed deformation.

As a result adapted coating amounts of gelatin were leading to a new assortment of films, differing in speed, called A, B', C', D', E', F' and G', which form an assortment of at least five films according to our invention, opposite to the assortment A, B, C, D, E, F and G, wherein hitherto only for 4 films (A, C, D and E as a borderline case) having a different speed it was possible to get the required drying characteristics with an acceptably good image quality.

We claim:

1. An assortment of at least five silver halide industrial X-ray photographic materials, to be processed in a processing cycle of an automatic processing machine following the steps of developing, rinsing, fixing, rinsing and drying, wherein each of said materials comprises at least one gelatino silver halide emulsion layer and at least one non-sensitive protective antistress coating on at least one side of a support, characterised in that for each of said materials the total amount of silver halide, expressed as the equivalent amount of silver nitrate, per square meter and per side is lying in the range from 7.5 to 15 grams, the total amount of gelatin coated in all of the hydrophilic layers present is such and the gelatin is hardened to such an extent that the amount of water absorption is substantially the same for each material and is not more than 2 grams per gram of gelatin after rinsing and before drying each material and that within said assortment the materials are differing in speed, and wherein the ratio of relative exposure factor for an exposure with a 200 kV radiation source with a copper filter of 8 mm thickness between a film of the said assortment having the lowest speed and a film of the said assortment having the highest speed is not less than 20.

2. Assortment according to claim 1, wherein an average grain size of silver halide emulsion crystals of said materials differing in speed are situated between 0.1 and 1.0 μm.

3. Assortment according to claim 1, wherein silver halide emulsion crystals are regular silver bromoiodide crystals comprising not more than 3 mole % of iodide.

4. Assortment according to claim 1, wherein a ratio by weight of gelatin to silver halide (expressed as an equivalent amount of silver nitrate) in each silver halide emulsion layer of each of the said materials differing in speed is comprised between 0.4 and 1.0.

5. Assortment according to claim 1, wherein the gelatin is hardened by means of a vinyl sulphonyl hardener.

6. Assortment according to claim 5, wherein the vinyl sulphonyl hardener is di-(vinyl-sulphonyl)-methane or ethylene di-(vinyl-sulphone).

7. Assortment according to claim 1, wherein at least one of said photographic materials differing in speed is a single-side coated material having on one side of a film support at least one emulsion layer and at least one protective antistress layer and on the other side of said support at least one backing layer.

8. Method of processing materials of an assortment according to claim 1, comprising the steps of developing, rinsing, fixing, rinsing and drying wherein drying proceeds with infrared drying means in the film-drying station of an automatic processor.

9. Method of processing materials of an assortment according to claim 8, wherein developing and/or fixing proceeds in hardener-free chemicals.

10. Method of processing materials of an assortment according to claim 8, wherein the processing proceeds in a total processing time from 3 to 12 minutes.

11. Assortment of at least four silver halide industrial X-ray photographic materials, to be processed in a processing cycle of an automatic processing machine following the steps of developing, rinsing, fixing, rinsing and drying, wherein each of said materials comprises at least one gelatino silver halide emulsion layer and at least one non-sensitive protective antistress coating on both sides of the film support, characterised in that for each of said materials belonging to the assortment the total amount of silver halide, expressed as the equivalent amount of silver nitrate, per square meter and per side is lying in the range from 7.5 to 15 grams, the total amount of gelatin coated in all of the hydrophilic layers present is such and the gelatin is hardened to such an extent that the amount of water absorption is substantially the same for each material and is not more than 2 grams per gram of gelatin after rinsing and before drying each material and that within said assortment the materials are differing in speed.

* * * * *